US006442854B1

(12) United States Patent
Liu et al.

(10) Patent No.: US 6,442,854 B1
(45) Date of Patent: Sep. 3, 2002

(54) FAST ALIGNMENT TELESCOPIC SIGHT

(75) Inventors: Kang Liu; Shusheng Xi, both of Wuhan (CN)

(73) Assignee: Wuhan Changjiang Optics Electron Co. Ltd. (CH)

( * ) Notice: Subject to any disclaimer, the term of this patent is extended or adjusted under 35 U.S.C. 154(b) by 0 days.

(21) Appl. No.: 09/539,035

(22) Filed: Mar. 30, 2000

(30) Foreign Application Priority Data

Aug. 27, 1999 (CN) ..... 99116615 A

(51) Int. Cl.[7] ..... F41G 1/38

(52) U.S. Cl. ..... 33/286; 33/227; 33/298; 42/122

(58) Field of Search ..... 33/227, 297, 298, 33/286; 42/111, 119, 120, 122, 124, 125, 126, 130, 135, 136, 137

(56) References Cited

U.S. PATENT DOCUMENTS 3,213,539 A * 10/1965 Burris ..... 42/122
3,777,404 A * 12/1973 Oreck ..... 42/120
3,902,251 A * 9/1975 Ross ..... 33/298
4,403,421 A * 9/1983 Shepherd ..... 42/122
4,689,910 A * 9/1987 Choate et al. ..... 42/136
5,363,559 A * 11/1994 McCarty ..... 42/122
5,463,495 A * 10/1995 Murg ..... 42/122
5,499,456 A * 3/1996 Tomita ..... 42/122
5,513,440 A * 5/1996 Murg ..... 42/122
5,615,487 A * 4/1997 Tomita ..... 42/122
5,771,623 A * 6/1998 Pernstich et al. ..... 42/122
5,867,915 A * 2/1999 McMillan ..... 42/126

FOREIGN PATENT DOCUMENTS

CN 94107796 4/1995

* cited by examiner

*Primary Examiner*—G. Bradley Bennett
(74) *Attorney, Agent, or Firm*—Kilpatrick Stockton LLP

(57) ABSTRACT

The invention relates to a fast alignment telescopic sight for use in connection with firearms to improve sighting accuracy. It comprises a tube, an optical sighting system, and an alignment unit. An alignment mark is provided in the target image plane of the optical sighting system, and is coupled to the tube through an adjustable connection unit. The adjustable connection unit comprises a base coupled to the tube, an adjustable positioning support mounted in the base, and a rotation pin passing through and secured to the adjustable positioning support. The alignment mark is secured to the front end of the rotation pin. The invention can be used for adjusting the alignment mark in arbitrary directions to ensure the alignment mark to be exactly located in the target image plane and at the center of the field of view against various manufacturing errors. The invention features simple construction, reliable performance and low manufacturing cost.

15 Claims, 3 Drawing Sheets

FAST ALIGNMENT TELESCOPIC SIGHT

The present application is based on the parallel Chinese patent application no. 99116615.9, which is incorporated herein by reference.

BACKGROUND OF THE INVENTION

The invention relates to a telescopic sight for use in connection with firearms to improve sighting accuracy.

It is well known that a telescopic sight can be used on a firearm to improve sighting speed and sighting accuracy. Prior to shooting, the sight must be aligned to make the sighting point coincide with the target point. CN 1038273 C, which is incorporated herein by reference, disclosed a sight that can be fast aligned. In this sight, an alignment mark is provided in the target image plane of the optical sighting system of the sight, by means of which the sight can be fast and efficiently aligned. The disadvantage of this structure is that, since the alignment mark should be located in the target image plane and at the center of the field of view, the alignment mark and the relevant connection means must be positioned accurately during assembling, which seems to be very difficult and expensive.

SUMMARY OF THE INVENTION

It is, therefore, an object of the present invention to provide a fast alignment sight in which the alignment mark can be easily aligned in the target image plane and at the very center of the field of view without increasing positioning accuracy of the alignment mark and the relevant connection means during assembling, while it is simple in structure, low in manufacture cost and therefore easy to be manufactured in large scale.

This and other objects of the invention can be achieved by adopting a adjustable connection unit to couple the alignment mark to the tube of the sight.

The adjustable connection unit comprises a base. coupled to the tube, an adjustable positioning support mounted in the base, and a rotation pin passing through and secured to the adjustable positioning support. The alignment mark is secured to the front end of the rotation pin.

The positioning support and thus the alignment mark can be properly adjusted in arbitrary directions, and therefore the impact of errors accumulated during assembling on the alignment can be eliminated, so that the alignment mark can be easily aligned in the target image plane and at the center of the field of view against possible positioning errors and/or manufacturing errors of the optical parts and components.

DESCRIPTION OF THE PREFERRED EMBODIMENTS

The invention will now be described with reference to the accompanying drawings.

Figure 1:
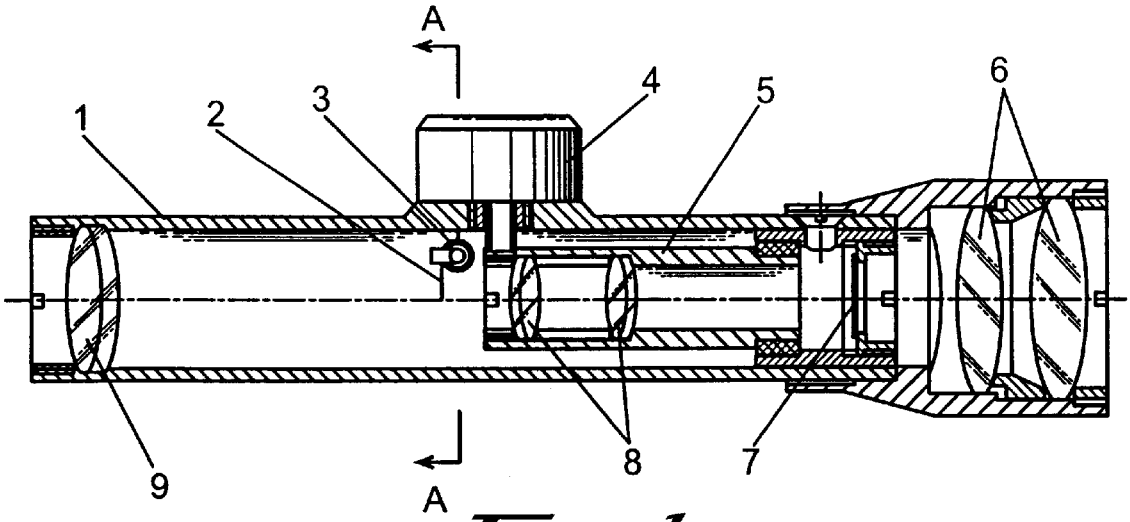
FIG. 1 is a general cross sectional view of the telescopic sight of the present invention.
Figure 2:
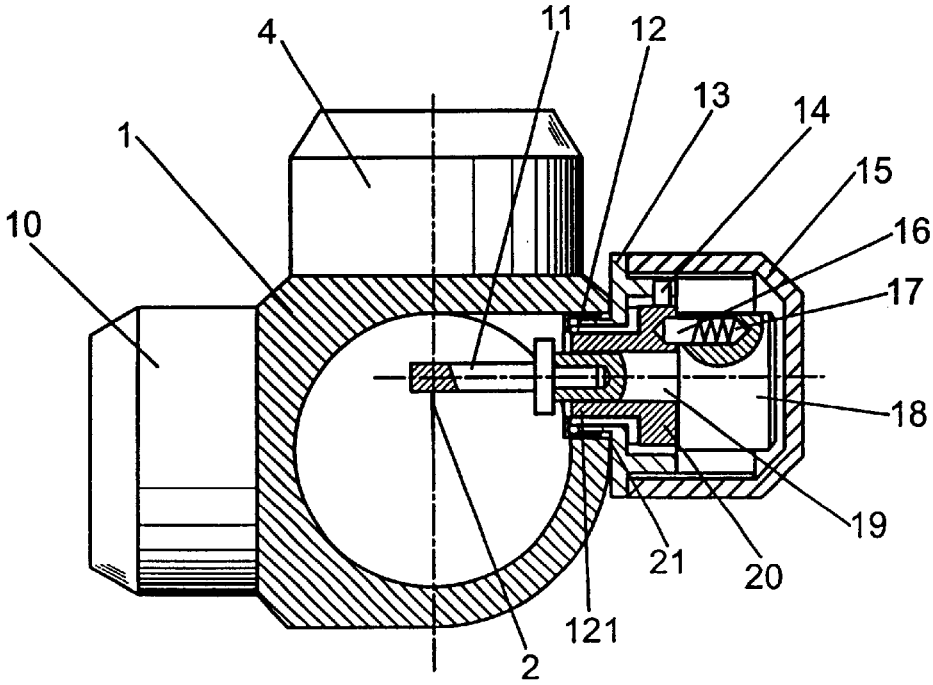
FIG. 2 is a sectional plan view taken along A—A of FIG. 1 according to a first embodiment of the present invention.

As illustrated in FIGS. 1 and 2, according to a first preferred embodiment, the telescopic sight includes a cylindrical tube 1, an optical sighting system comprising an objective lens 9 provided at the front end of the tube 1, an ocular lens 6 at the back end, inverting lenses 8 and a reticule 7 mounted in the tube 1, and an alignment unit 5 mounted in the tube 1, adjacent to the inverting lenses 8. A top-down adjustment hand wheel 4 and a right-left adjustment hand wheel 10 are provided outside the tube 1, to adjust and align the alignment mark. In front of the inverting lenses 8 and in the back focal plane (target image plane) of the objective lens 9, there provided an alignment needle 2, which is reversible and movable, to function as the alignment mark. Alternatively, markings made on a transparent plate can also serve the purpose of the alignment mark. Furthermore, the alignment mark can be also positioned in the target image plane between the inverting lenses 8 and the ocular lens 6. The tail of the alignment needle 2 is coupled to an adjustable connection unit 3, which includes a base 13 coupled to the tube 1, an adjustable positioning support 20 mounted in the base 13 and a rotation pin 19 mounted in the positioning support 20. The positioning support 20 is connected through an elastic rubber ring 21 to the base 13. There are three or four adjustment screws 14 provided in radial direction along the edge of the base 13. The rotation pin 19 passes through the positioning support 20 and is coupled by a nut 12 and a lubricant washer 121 thereto. One end of the rotation pin 19 is secured to a knob 18. On the inner side of the knob 18, an elastic pin which includes a positioning pin 16 and a spring 17 is provided, for the purpose of matching a corresponding slot hole in the end surface of the positioning support 20 to make the rotation pin 19 have two fixed positions at an angle of 90°. The other end of the rotation pin 19 is engaged with a joint bar 11 which is shaped like an eccentric shaft and deflected toward either the objective lens 9 or the ocular lens 6. The front end the joint bar 11 is coupled to the alignment needle 2. The alignment needle 2 can leave the field of view completely when it is turned upwardly through rotating the knob 18. In addition, there is a cover 15 on the outer side of the base 13. In the first preferred embodiment, the positioning support 20 can be adjusted through the adjustment screws 14. the rotation pin 19 drives the alignment needle 2 to achieve adjustment in top-down and back-forth directions. Adjustment in right-left direction can be achieved by adjusting the depth to which the joint bar 11 is engaged into the rotation pin 19. Therefore, according to the present invention, the alignment needle 2 can be shifted and adjusted slightly in arbitrary direction to accurately position the tip of the alignment needle 2 to be at the center of the field of view without parallax.

The adjustment procedure of the first embodiment is as follows. First, remove the cover 15 and rotate the knob 18 to move the alignment needle 2 into the field of view. Then, adjust and align the needle 2 by adjusting the screws 14 and/or changing the engagement depth of the joint bar 11, so that the tip of the needle 2 is exactly in the target image plane and at the center of the field of view. Finally, rotate the knob 18 in opposite direction to make the needle 2 leave the field of view and put on the cover 15.

Figure 3:
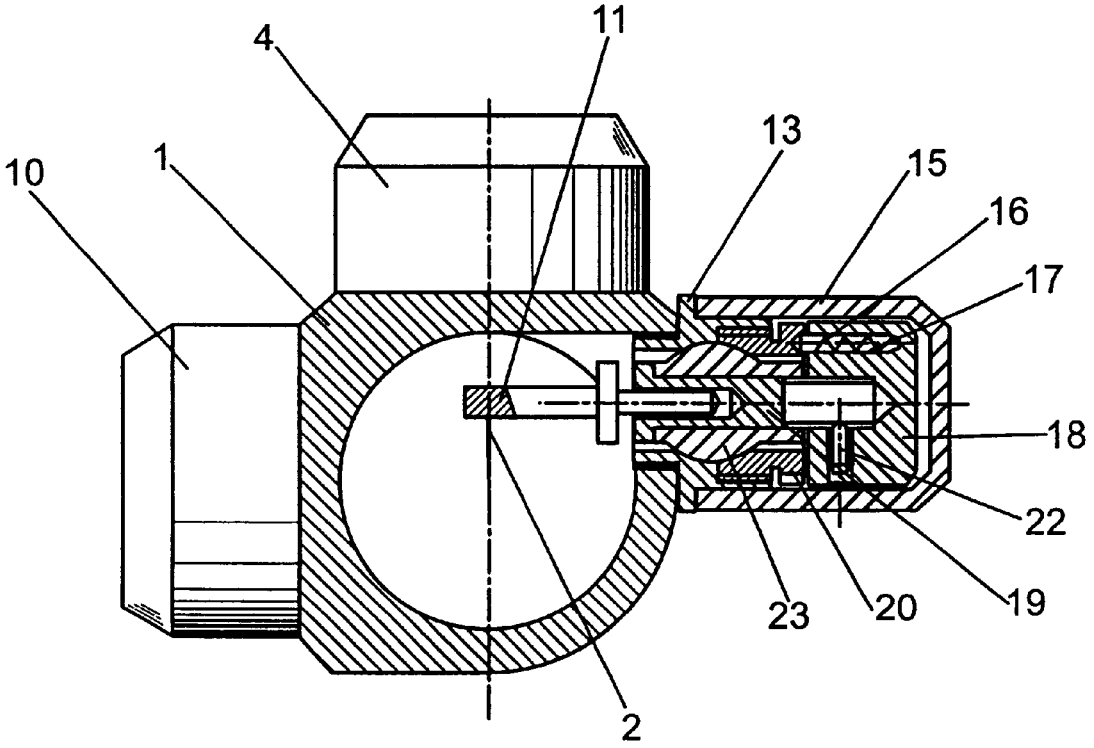
FIG. 3 is a sectional plan view taken along A—A of FIG. 1 according to a second embodiment of the present invention.

A second embodiment is shown in FIG. 3. It is similar to the first embodiment except that the positioning support 20 is screwed into the base 13 and there are two semi-spherical cavities between the positioning support 20 and the base 13, in which a spherical sleeve 23 is provided. The rotation pin 19 passes through the spherical sleeve 23. One end of the rotation pin 19 engages into the knob 18 and is fastened by a screw 22. The alignment needle 2 can be adjusted and aligned in up-down and back-forth directions by swinging and rotating the spherical sleeve 23. After adjustment, the spherical sleeve can be tightly locked by means of the positioning support.

As can be easily understood, the alignment needle 2 and the joint bar 11 in the above two embodiments can be formed as a single part.

Figure 4:
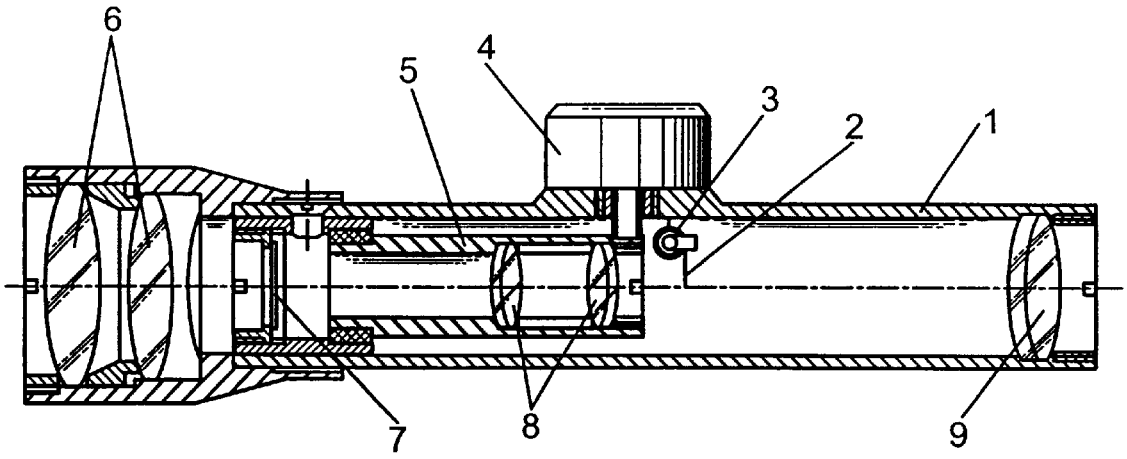
FIG. 4 is a general cross sectional view of the telescopic sight according to a third embodiment of the present invention.
Figure 5:
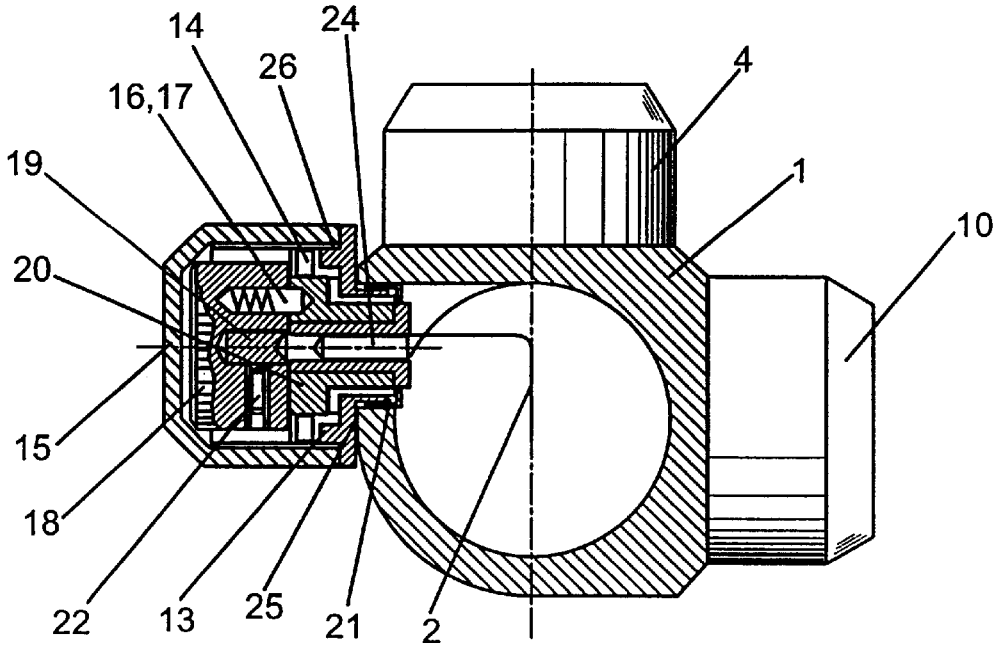
FIG. 5 is a sectional plan view taken along A—A of FIG. 4.

A third embodiment is illustrated in FIGS. 4 and 5. In this embodiment, the alignment needle is L-shaped, the tail of which is directly secured to the rotation pin 19 through a bolt 24. The other end of the rotation pin is screwed into the knob 18 and is fastened by a screw 22. The positioning support 20 is connected through an elastic rubber ring 21 to the base 13. There are four adjustment screws 14 provided in radial direction, along the edge of the base 13. In addition, the base 13 is coupled to the tube 1 through a washer 25, and an O-ring is provided between the base 13 and the cover 15. The connection unit 3 is provided on the left side of the tube 1, adjacent to the top-down adjustment hand wheel 4. The other parts of the third embodiment are similar to those of the first and the second embodiments, and hence the detailed description thereof is omitted.

The above-described embodiments are simple in structure, high in performance, easy to manufacture, low in cost, and easy to produce on a large scale. As for how to use the telescopic sight of the invention, see the detailed description in CN 1038273C.

While this invention has been particularly shown and described with references to the preferred embodiments thereof, it will be understood by those skilled in the art that various changes in form and details may be made therein without departing from the spirit and scope of the invention as defined by the appended claims.

What is claimed is:

1. A fast alignment telescopic sight, comprising:

a tube;

an optical sighting system comprising an objective lens provided at the front end of said tube, an ocular lens provided at the back end of said tube, and inverting lenses and a reticule mounted in the tube;

an alignment unit provided in said tube;

an alignment mark positioned in the target image plane of said optical sighting system; and an adjustable connection unit, by means of which said alignment mark is coupled to said tube so as to align the alignment mark in the target image plane.

2. A fast alignment telescopic sight according to claim 1, wherein said adjustable connection unit comprises a base coupled to said tube;

an adjustable positioning support mounted in said base; and a rotation pin mounted in said adjustable positioning support.

3. A fast alignment telescopic sight according to claim 2, further comprising a joint bar, the back end of which is engaged into the front end of said rotation pin and the front end of which is coupled to said alignment mark; and a knob, to which the other end of said rotation pin is secured, and on the inner side of which an elastic pin is provided cooperating with a corresponding slot hole in the end surface of said positioning support to make said rotation pin have different fixed positions.

4. A fast alignment telescopic sight according to claim 2, wherein said adjustable positioning support is coupled to said base through an elastic rubber ring;

said rotation pin passes through said adjustable positioning support and secured thereto; and a plurality of adjustment screws are provided in radial direction along the edge of said base.

5. A fast alignment telescopic sight according to claim 3, wherein said adjustable positioning support is screwed into said base;

two semi-spherical cavities are formed between said adjustable positioning support and said base, in which a spherical sleeve is provided; and said rotation pin passes through said sleeve and secured thereto, and is engaged into said knob.

6. A fast alignment telescopic sight according to claim 4, wherein said joint bar is shaped like an eccentric shaft which is deflected in the direction of the axis of said tube, so that said alignment mark can leave the field of view completely when it is turned upwardly.

7. A fast alignment telescopic sight according to claim 4, wherein said joint bar and said alignment mark are formed as a single part.

8. A fast alignment telescopic sight according to claim 3, wherein said joint bar and said alignment mark are integrally formed as a L-shaped part, the tail of which is directly secured to the front end of said rotation pin;

said rotation pin passes through said adjustable positioning support and secured thereto;

the other end of said rotation pin is screwed into said knob;

said adjustable positioning support is coupled to said base through an elastic rubber ring; and a plurality of adjustment screws are provided in radial direction along the edge of said base.

9. A fast alignment telescopic sight according to claim 4, wherein said base is coupled to said tube through a washer.

10. A fast alignment telescopic sight according to claim 4, further comprising a cover on the outer side of said base, wherein an O-ring is provided between said base and said cover.

11. A fast alignment telescopic sight according to claim 8, wherein said connection unit is provided on the left side of said tube.

12. A fast alignment telescopic sight according to claim 1, wherein said alignment mark is a needle.

13. A fast alignment telescopic sight according to claim 1, wherein said alignment mark is a transparent plate on which markings are made.

14. A fast alignment telescopic sight according to claim 1, wherein the target image plane is between said inverting lenses and said objective lens.

15. A fast alignment telescopic sight according to claim 1, wherein the target image plane is between said inverting lenses and said ocular lens.

* * * * *